United States Patent [19]

Stark

[11] 4,259,818

[45] Apr. 7, 1981

[54] TAMPER-PROOF WINDOW UNIT

[75] Inventor: Carroll Stark, North Hollywood, Calif.

[73] Assignee: Anemostat Products Division, Dynamics Corporation of America, New York, N.Y.

[21] Appl. No.: 62,284

[22] Filed: Jul. 31, 1979

[51] Int. Cl.[3] ..... E06B 3/58; E06B 3/26

[52] U.S. Cl. ..... 52/208; 52/212; 52/217; 52/770; 52/824; 49/171

[58] Field of Search ..... 49/171; 52/208, 212, 52/217, 769, 770, 824, 825

[56] References Cited

U.S. PATENT DOCUMENTS

| | | | |
|---|---|---|---|
| 2,996,767 | 8/1961 | Kobil et al. | 52/212 |
| 3,969,857 | 7/1976 | Stark | 52/208 |
| 4,021,967 | 5/1977 | Mulder et al. | 52/824 |

FOREIGN PATENT DOCUMENTS

| | | | |
|---|---|---|---|
| 1119493 | 12/1961 | Fed. Rep. of Germany | 52/769 |

*Primary Examiner*—James L. Ridgill, Jr.
*Attorney, Agent, or Firm*—McCormick, Paulding & Huber

[57] ABSTRACT

An improved tamper-proof window unit comprising similar first and second quadrilateral centrally open frame members adapted to be mounted about an opening respectively on opposite sides of a door. Each frame member has a narrow elongated quadrilateral front panel extending generally in a plane parallel to the door and marginally about the door opening with an outer edge portion partially overlapping the door adjacent the opening. A small countersunk front-to-rear screw hole is provided on each side of the front panel to communicate with the door opening. A narrow elongated quadrilateral and generally L-shaped integral flange extends along the front panel with each L-shaped flange comprising first and second panels. The first panel of each flange projects generally rearwardly and the second panel projects from the rear edge of the first panel outwardly with respect to the door opening. The second panels of opposite frame members are spaced to receive and hold edge portions of a pane of glass when screws are entered in the front panel openings and engaged with said panels to assemble the frame. Spring clips mounted on the second panels temporarily retain one frame member in the door opening, locate the frame relative to the opening, and locate the pane of glass relative to the frame and door opening.

14 Claims, 6 Drawing Figures

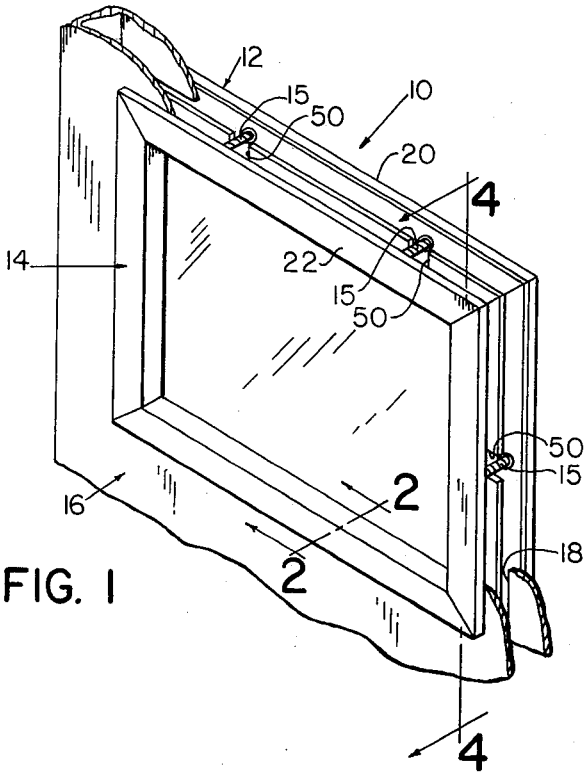
FIG. 1
FIG. 3
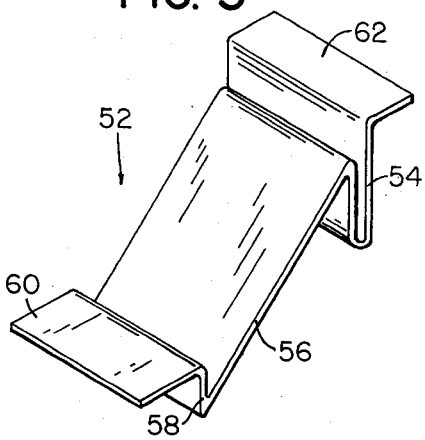
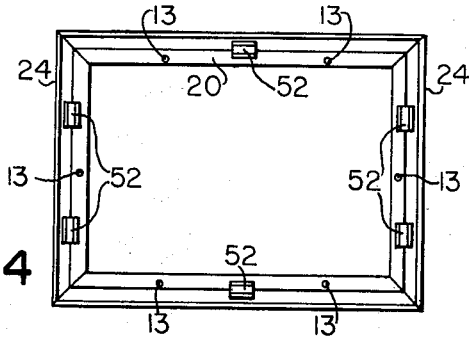
FIG. 4
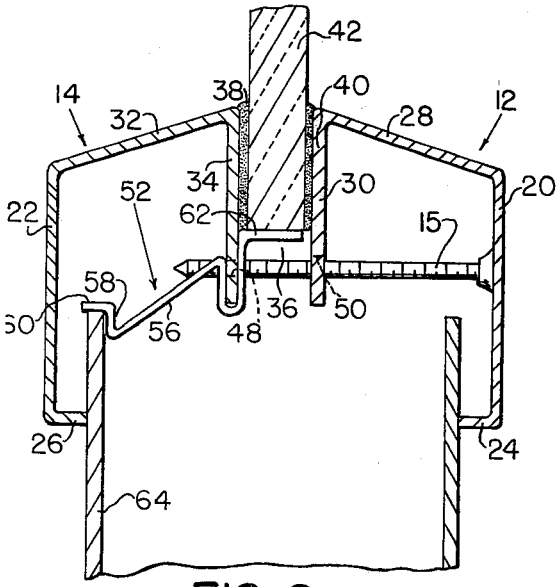
FIG. 2
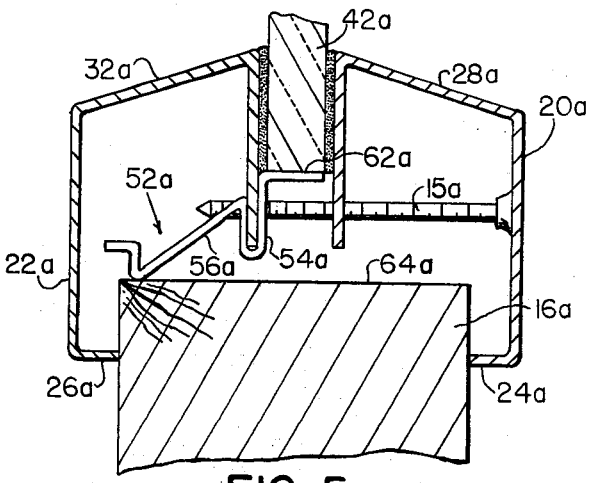
FIG. 5
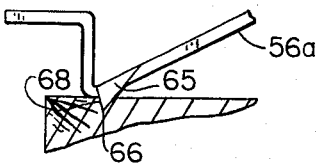
FIG. 6

TAMPER-PROOF WINDOW UNIT

BACKGROUND OF THE INVENTION

Tamper-proof window units for use in steel doors and the like have been available in the past as illustrated by U.S. Pat. No. 3,969,857, Tamper-proof Window Unit, issued July 20, 1976. In assemblying window units such as illustrated in the patent, it is of course desirable to locate the window or other pane of transparent material centrally within the opening of the door. Further, the frames are ordinarily assembled individually in the window opening in the door. That is, a frame member or assembly may be mounted on one side of a door, the door thereafter rotated through 180° on a work bench or other support, and a second frame member assembled in the window opening on an opposite side of the door. The two frame members or assemblies are then permanently secured together as by means of connecting screws.

In the past, locating of the window unit and its pane of glass or other transparent material relative to the window opening in the door has been a relatively slow and tedious operation. Similarly, the temporary retention of one frame member or assembly in a door opening has been accomplished manually or with relatively crude means during door rotation and insertion and assembly of the second frame member or assembly.

It is the general object of the present invention to provide a simple and inexpensive means for expeditiously locating a window frame, and a pane of glass or the like therein in a desired position in the window opening of a door or the like, said means serving also as a temporary retention means for holding one frame member or assembly in position in a door opening during as assembly procedure involving the rotation or other manipulation of the door.

SUMMARY OF THE INVENTION

In fulfilling the foregoing object, an improved tamper-proof window unit is provided with first and second similar frame members respectively for mounting on opposite sides and partially within a window opening in a door. The frame members have front panels which extend around the door opening and at least partially overlap marginal portions of the side surfaces of the door adjacent its opening. Flanges on the front panels extend rearwardly and are generally L-shaped so as to have first and second panels with the latter extending outwardly with respect to the center of the door opening and generally in a plane parallel with the side surfaces of the door. A slot is defined between the second panels of the two frame members with the panels in spaced relationship and the marginal portions of a pane of glass or other transparent material are received in and subsequent to assembly, securely held by the second panels.

Connecting elements in the form of screws, bolts, etc. are employed to permanently secure the two opposing frame members or assemblies in position in the window opening of the door. Further, tamper-proof construction on at least one side of the door is provided for by having the connecting elements enter through only one frame front panel. That is, the connecting elements have their heads exposed on only one side of the door and extend through the front panel of one frame member to interconnect the two frame members or assemblies by engaging the second panel of the opposite frame member or assembly within the door opening.

Locating and retention means provided in accordance with the present invention take the form of spring clips with at least two clips provided and mounted on the second panels of the frame members in generally opposite positions across the window opening. Each spring clip has a flexible arm which engages an adjacent portion of the wall of the window opening in the door and with the arms slightly flexed the clips urge the frame member or members to a central position within the window opening of the door in at least one direction. Preferably, at least four (4) clips are provided with the clips arranged in pairs on the second panels of the frame members and the pairs of clips are arranged along lines generally opposite each other with the lines angularly displaced by approximately 90°. Thus, the frame member or members are located centrally in two (2) perpendicular directions. The clips also include tabs which extend into the pane receiving slots between the second panels and form a partial base wall for the slot. Marginal edge portions of the pane of glass or other transparent material engage the tabs so as to be located and centered within the frame members and within the window opening in the door.

In their temporary retention function, the spring clips have forwardly facing surfaces near their end portions which cooperate with rearwardly facing surfaces on or adjacent the wall of the window opening in the door whereby to restrain a single frame member against rear-to-front displacement in the door opening. This of course requires at least two spring clips generally oppositely located across the window opening and on the second panel of a single frame member or assembly. When a hollow door is used the rearwardly facing surfaces are provided by an inner or rear surface of a side wall of the door adjacent the window opening and the clips have an outwardly and forwardly inclined portion of their arms extending from a portion thereof mounted on the second panels. As a frame member is urged perpendicularly to the side surface of the door into a window opening the clips are cammed inwardly toward the center of the door opening and then snapped into position with their forwardly facing surfaces engaging the rearwardly facing surfaces on the side wall of the door. Temporary retention of the frame member in the window unit is thus provided for.

When a solid wood door of a relatively soft material is employed, the spring clips are provided with small lanced portions near their ends but are otherwise similar to the clips described above. As a frame member or assembly is urged perpendicularly into its window opening, the arms on the clips are flexed inwardly toward the center of the window opening and the small lanced portions of the arms at least slightly cut into the wood or other soft material whereby to provide small shoulders or surfaces which face rearwardly and which engage the forwardly facing end surfaces of the lanced portions whereby to provide for retention of the frame member or assembly temporarily and during manipulation of the door for assembly of the second or opposite frame member.

BRIEF DESCRIPTION OF THE DRAWINGS

FIG. 1 of the drawings is a perspective view partially broken away for clarity and illustrating an improved tamper-proof window unit construction in accordance with the present invention, a portion of an associated hollow door being illustrated therewith.

FIG. 2 is an enlarged sectional view taken generally as indicated at 2—2 in FIG. 1 and showing first and second window frame members, a portion of the door, and an associated pane of glass.

FIG. 3 is an enlarged perspective view of a spring clip forming an essential part of the present invention.

FIG. 4 is a sectional view taken generally as indicated at 4—4 in FIG. 1 and showing a single frame member or assembly with spring clips mounted thereon.

FIG. 5 is an enlarged fragmentary sectional view similar to FIG. 2 but showing the improved window unit of the present invention in association with a solid door of wood construction or the like.

FIG. 6 is an enlarged fragmentary view showing an end portion of a spring clip arm with a lanced portion thereof cooperating with a solid door of wood or the like.

DETAILED DESCRIPTION OF PREFERRED EMBODIMENTS

Referring particularly to FIG. 1, it will be observed that an improved tamper-proof window unit in accordance with the present invention is indicated generally at 10 and comprises similar first and second frames or frame members 12, 14. The unit is adapted for assembly in doors, partitions, etc. and as shown in FIG. 1 the unit is assembled in a door 16 with the tamper-proof side of the unit disposed toward the viewer. The door 16 is shown of hollow steel construction but door construction may vary widely within the scope of the invention. A multilateral window opening 18, shown in the common form of a quadrilateral or four sided opening is provided in the door for insertion and assembly of the window unit 10. In accordance with the invention, and while the window unit is described as multilateral, it is to be understood that the term multilateral is used in a broad sense to include three sided configurations, four sided configurations, etc. and even circular or other arcuate forms which may be regarded as comprising an infinite number of sides.

When a door is provided with a quadrilateral window opening as illustrated, the window frame members 12, 14 are of course also of a quadrilateral configuration and are preferably constructed from formed sheet metal although other materials of construction may be employed within the scope of the invention. As mentioned, the frame members 12 and 14 are similar and in the preferred form shown, the frame members or frames are of identical cross section throughout at least in their initial stages of forming. Thus, the frames may be constructed at economic advantage, for example by roll forming or by press-break forming, miter cut and thereafter welded or otherwise joined at their corners to provide finished assemblies. The first frame member 12 has six (6) small countersunk front-to-rear openings 13, 13 and six (6) screws 15, 15 have their heads exposed. Thus, the first frame member 12 may be on an interior or private side of the door 16 while the second frame member 14 having no visible means of attachment is adapted for a public or tamper-proof side of the door.

The first and second frames 12, 14 each have a front panel which is multilateral, quadrilateral as shown, and which takes a narrow elongated configuration extending generally in a plane parallel to the door and marginally about the door opening with an outer edge portion partially overlapping the door adjacent the opening. Such panels are shown at 20, 22 respectively for the frames 12, 14 and each panel has top, bottom, and left and right hand side portions. To provide a finished edge, the outer edge portion of each of the front panels 20, 22 includes a narrow elongated flange which projects rearwardly toward the door. Such flanges are shown for the panels 20, 22 respectively at 24, 26 and each of the panels includes top, bottom, left and right hand sides as best illustrated in FIG. 2.

Each frame or frame member also has a narrow elongated generally L-shaped integral flange which extends along the inner edge of its front panel and each such flange comprises integral first and second narrow elongated panels. As shown, the front panel 20, FIG. 2, has an L-shaped flange with a first panel 28 and an integral second panel 30, while the front panel 22 is provided with an L-shaped flange having a first panel 32 and a second panel 34. Each of the first panels 28, 32 projects generally rearwardly from its associated front panel and, as illustrated, the panels 28, 32 project rearwardly and also at a slight angle of inclination inwardly in the direction of the center of the window opening in the door. The second panels 30, 34 project form a rear or inner edge of their respective first panels outwardly with respect to the center of the door opening and in a plane generally parallel with the door side surfaces and the front panels 20, 22.

Still referring to FIG. 2 it will be observed that the two second panels 30, 34 on first and second or opposite frames 12, 14 reside in spaced apart parallel relationship to define a slot 36. The slot 36 opens inwardly toward the center of the door opening and, as illustrated, opens both inwardly and outwardly and is adapted to receive and hold a marginal portion of a pane of glass or other transparent material. Two thin layers of mastic 38 and 40 are shown disposed in the slot respectively between the panels 30, 34 and a pane of glass 42. It should be understood, however, that a single layer of mastics such as 38 or 40 may suffice in many installations. The pane of transparent material 42 may be of the common window glass type, an impact resistant polycarbonate, a fire retardant type, etc.

In interconnecting and finally assembling the frames 12, 14 in the window opening 18, the second panel 34 of the second frame member 14 is provided with six (6) small front-to-rear openings 48, 48 and the openings are arranged in front-to-rear alignment respectively with the aforementioned six (6) openings 13, 13 in the front panel 20 of the frame member 12. A single opening 48 is shown in FIG. 2 in the second panel 34 receiving a screw 15 entered in an opening 13 and having its head countersunk in the panel 20. The second panel 30 is provided with a notch 50 for clearance in passage of the screw 15. Three (3) such notches are shown in FIG. 1 and it will be understood that each of the screws 15 has an associated opening 48, 48 in a panel 34 and an associated notch 50 in second panel 30. A variety of connecting elements may be employed within the contemplation of the invention but it is presently preferred that six (6) screws 15, 15 be employed and the screws may take the form of ordinary sheet metal screws with special tamper-proof connecting element construction being unnecessary.

In providing the aforementioned locating and temporary retention functions, at least two (2) spring clips are employed and, preferably, six (6) spring clips are utilized as illustrated in FIG. 4. The clips are or may be of identical construction and a representative clip is shown in FIG. 3 at 52. Spring metal construction is preferred with each clip 52 having a portion thereof adapted for mounting on a second panel 34 at an outer edge portion of the latter. A narrow generally U-shaped portion 54 of the clip 52 is so adapted and when the clip is pressed onto an edge portion of a second panel it is retained thereon by spring action of the legs of the U-shaped portion. A main or body portion 56 of the clip arm is formed integrally with the U-shaped portion 54 and extends therefrom to an intermediate arm portion 58, integral therewith, and thence to an end portion 60, also integrally formed. A tab 62 extends in a generally opposite direction from the U-shaped mounting portion 54.

Referring now to FIG. 2, it will be observed that a spring clip 52, mounted on an outer edge portion of a second panel 34, has its arm portion 56 extending generally forwardly and outwardly with its intermediate portion 58 disposed inwardly of a side wall 64 of hollow door 16. The end portion 60 of the clip 52 engages the end surface of the side wall 64 or, the wall defining the opening 18 in the door 16. Further, the arm portion 56 of the clip 52 is in at least a slightly flexed condition as illustrated in FIG. 2. Thus, with a similar clip mounted on the second panel 34 across or generally opposite the clip 52 illustrated, the frame member 14 is automatically urged to a central position within the window opening 18 of the door 16. Further, the tab 62 enters the slot 36 and forms at least a partial base wall therefor to engage a marginal portion of the pane of glass 42 and to similarly center the glass within the frame and the window opening.

It is contemplated that at least two clips 52, 52 be employed in a generally opposite arrangement across the window opening and frame and, in the presently preferred form and as illustrated in FIG. 4, six (6) clips 52, 52 are employed. The clips may all be mounted on a single second panel such as 34, they may be alternately mounted on second panels of opposing frames such as 30, 34 or, they may be all mounted upon a second panel 30 of a first frame or frame member 12. Preferably, and as will be explained more fully hereinbelow, all clips 52, 52 are mounted on a single frame or frame member or, more specifically, on the second panel thereof.

In the fully assembled condition of FIG. 2, the clips 52, 52 have previously fulfilled their locating function during assembly of the frame or frame members in the window opening. While there may be some continuing locating function of the clips in providing resistance against unintended or accidental displacement of the frame or window in the plane of the door, the clamping action of the screws 15, 15 provides the principle locating and retention function after assembly.

During assembly of the frames 12, 14 and the pane of glass 42 into the window opening, the clips 52, 52 serve as the sole locating means for the frames and the pane of glass 42. That is, the clips 52, 52 are preferably mounted on a single second panel 34 prior to assembly of the frame 14 in the window opening. Assembly is accomplished by achieving a relative movement of the frame and door in a direction perpendicular to the plane of the door and conventionally the door may be supported on a work bench or other supporting means with the frame being moved perpendicularly in a front-to-rear direction during such assembly. As will be apparent, the forward and outward inclination of the arm portion 56 on each clip provides for a camming action whereby the inner edge of the door wall 64 causes the arm to be flexed inwardly and then to snap outwardly to the position shown. In the position shown a forwardly facing surface on the intermediate portion 58 of each clip arm is disposed adjacent a rearwardly facing surface on the door side wall 64. The said two surfaces reside generally in a plane parallel to the plane of the door side surfaces whereby the frame 14 is temporarily retained in the position shown in FIG. 2. Simultaneously, with the arms of the spring clips remaining in a slightly flexed condition, the end portions thereof 60, 60 engage the end surfaces of the side wall 64, or the wall of the opening 18, and serve to locate the frame 14 in its proper central position within the window opening.

When the frame or frame member 14 has been mounted in the window opening 16 as described, the door 16 may thereafter be rotated or otherwise manipulated through 180° on its work bench or other support means to facilitate insertion of the frame 12 and the window pane 42. The pane of glass or other transparent material 42 is first placed in position with the tabs 62, 62 on the spring clips serving to locate the same in its proper central position. Subsequently, and on completion of the mastic operation, the frame or frame member 12 may be placed in position as illustrated in FIG. 2 with the screws 15, 15 entered through the openings 13, 13 in the front panel 20 and the threaded openings 48, 48 in the second panel 34 of the frame member 14. On tightening of the screws 15, 15, the assembly operation is complete with frame and window properly located and secured relative to the window opening 18 in the door 16.

In FIG. 5 the construction is substantially identical with that described except for the provision of a solid door 16a and a slightly modified spring clip 52*a*. The solid door 16*a*has a wall 64*a* which defines the window opening 18 and which cooperates with the spring clips in the locating and temporary retention of the frame and associated pane of glass. Some of the parts are similarly numbered with the suffix "a" for the frames and window pane.

As best illustrated in FIG. 6 the main or body portion 56*a* of each spring clip 52*a* has a small lanced portion 65 with a relatively sharp lower edge 66 and a forwardly facing surface 68 adjacent thereto.

Operation of the spring clips 52*a*, 52*a* is substantially identical with the operation of the clips 52, 52. With the clips 52*a*, 52*a* modified as shown the frame member 14a is urged in a direction perpendicular to the plane of the door 16a causing the arm portions 56*a*, 56*a* on the clips 52*a*, 52*a* to flex inwardly at the urging of the camming action exerted by the corner portion of the wall 64 on the door 16a. When the frame has reached the assembled position shown in FIGS. 5 and 6 the small lanced portions 64 on the clips tend to cut slightly into the relatively soft wood or other material of the door 16a with the sharp edge 66 entering the wood. Thereafter, the forwardly facing surfaces 68, 68 on the clips engage a small rearwardly facing surface or shoulder formed in the wood whereby to provide the desired temporary retention of the frame member in the door opening. Further, with the arms of clips 52*a*, 52*a* residing in a slightly flexed condition, the locating function of the clips is achieved in the same manner as described above for the clips 52, 52.

As will be apparent from the foregoing, the improved tamper-proof window unit of the present invention provides for a high degree of ease and convenience in assembly. The spring clips 52, 52 or 52*a*, 52*a* are merely mounted on the appropriate second panels of a first frame or frame member to be assembled with the door. Thereafter, it is merely necessary to move the frame into position in a perpendicular direction with the clips serving automatically to locate the frame and to retain the same temporarily for rotation or other manipulation of the door. When the glass pane has been positioned and the opposing frame or frame member placed in position thereover, the several sheet metal screws are entered and tightened in position and a rapid and efficient assembly procedure is complete.

I claim:

1. An improved tamper-proof window unit for assembly in multilateral openings in doors and the like; said unit comprising similar and mating first and second multilateral centrally open frame member adapted to be mounted about and marginally within a corresponding opening and respectively on opposite sides of a door, each of said frame members comprising a narrow elongated multilateral front panel extending generally in a plane parallel to the door plane and marginally about the door opening with an outer edge portion partially overlaying the door side surface adjacent the door opening, the front panel of said first frame member having at least one small front-to-rear opening arranged to communicate with the door opening through each of at least two generally opposite sides of the panel, and each frame member also comprising a narrow elongated multilateral generally L-shaped flange extending along and connected to the inner edge of its front panel, each L-shaped flange including a first narrow elongated panel which projects generally rearwardly from its associated front panel and a second narrow elongated panel which projects from a rear edge of the first panel outwardly with respect to the center of the door opening and in a plane generally parallel with the door side surfaces and frame front panels, the two second panels on the opposite frame members being spaced apart in parallel relationship with the frame assembled in the door opening whereby to define a slot which opens inwardly toward the center of the door opening and which is adapted to receive and hold a marginal portion of a pane of transparent material, a pane of transparent material disposed in the door and frame opening with its marginal portion entered in said slot, at least two similar spring clips mounted respectively on outer free edge portions of said second panels and in generally opposite relationship across the door and frame opening, each of said clips having a deflectable arm which projects generally forwardly and outwardly from its associated panel edge portion and which at its free end engages a wall defining the aforesaid opening in the door, each of said arms being flexed at least slightly inwardly at its free end by such engagement and said two spring clips thus serving cooperatively to locate said frame in at least one direction centrally within the door opening, and at least two connecting elements associated respectively with said two small front-to-rear openings in said front panel of said first frame member and projecting therethrough in a front-to-rear direction to engage said second frame member whereby to interconnect the frame members and thus secure the window unit and door in assembly with said front panels of said first and second frame members clampingly engaging opposite sides of the door adjacent its opening and with said two second panels clampingly holding the marginal portions of the pane of transparent material therebetween.

2. An improved tamper-proof window unit as set forth in claim 1 wherein each of said spring clips includes a window locating tab, said tabs projecting on generally opposite sides of the frame at least partially across the slot between said second panels whereby to form a base wall for the slot and to engage marginal edge portions of the pane of transparent material and locate the same.

3. An improved tamper-proof window unit as set forth in claim 1 wherein at least four (4) similar spring clips are provided and are arranged in pairs and mounted on outer free edge portions of said second panels in generally opposite relationship along two lines approximately at 90° to each other, each of said spring clips having its deflectable arm in engagement with an adjacent portion of the wall of the door which defines the window opening therein, and each of the arms being flexed at least slightly inwardly at its free end by such engagement whereby the several spring clips cooperatively locate said frame in at least two right angularly related directions centrally within the door opening.

4. An improved tamper-proof window unit as set forth in claim 1 wherein said spring clips are mounted on free edge portions of the second panels of a single frame member, and wherein each of said clips is adapted to engage its adjacent door opening wall in such manner as to temporarily retain the frame member against rear-to-front displacement with the frame member entered in the door opening during an initial stage of assembly, manipulation of the door and frame in an assembly procedure thus being permitted for ready insertion and mounting of the opposite frame member.

5. An improved tamper-proof window unit as set forth in claim 2 wherein each of said spring clips includes a surface on its flexible arm arranged toward its free end and which lies generally in a plane parallel to the plane of the side surfaces of the door, said arm surfaces facing generally forwardly, and wherein the wall of the window opening in the door is provided with mating rearwardly facing surfaces for engagement by said arm surfaces, said arm and door wall surfaces serving cooperatively to retain the frame temporarily in position within the window opening in the door as aforesaid.

6. An improved tamper-proof window unit as set forth in claim 5 wherein said door is of a hollow construction having spaced apart side walls with end surfaces thereof forming the aforesaid wall of the window opening therein, and wherein rearwardly facing surfaces of the door side walls adjacent the end surfaces thereof form the aforesaid surfaces engageable with the arm surfaces for temporary frame retention.

7. An improved tamper-proof window unit as set forth in claim 5 wherein the door is of solid construction of a relatively soft material such as wood, and wherein the aforesaid arm surfaces have sharp outer edges so as to slightly cut into the material of the door at the wall of its window frame opening and thereby to form in the door material the aforesaid mating rearwardly facing surfaces.

8. An improved tamper-proof window unit as set forth in claim 5 wherein each of said spring clips includes a narrow generally U-shaped portion adapted to fit about said free edge portion of its associated second panel and to clampingly engage opposite sides of the panel so as to be retained thereon.

9. An improved tamper-proof window unit as set forth in claim 8 wherein each of said spring clips has a generally Z-shaped arm with a body portion thereof projecting from the aforesaid U-shaped portion of the clip forwardly to a point adjacent a front edge of the wall of the door opening, an intermediate portion thereof projecting in a plane generally parallel with the plane of the door side surfaces and inwardly toward the center of the door opening, and an end portion thereof projecting in a plane generally perpendicular to the plane of the door surfaces and generally parallel with the plane of the wall of the window opening in the door.

10. An improved tamper-proof window unit as set forth in claim 9 wherein the door is of a solid construction and of relatively soft material and wherein said clip arms are provided with surfaces adjacent their front ends lying in a plane generally parallel with the door side surfaces and having sharp outer edges, wherein the clip arms are arranged to project from said U-shaped portions of the clips generally forwardly and outwardly so as to be cammed inwardly during frame insertion, the sharp outer edges of the aforesaid surfaces serving to at least slightly cut into the soft material forming the wall of the frame opening during insertion of the frame perpendicularly to the window opening and with the spring clip arms flexed, said slight cutting action serving to form rearwardly facing surfaces in the material of the door wall for engagement with the forwardly facing surfaces on the arms and for temporary retention of the frame in the window opening as aforesaid.

11. An improved tamper-proof window unit as set forth in claim 10 wherein said forwardly facing surfaces on the flexible arms of the spring clips are provided by lancing a small section of each arm outwardly at a location slightly removed from the free end of the arm.

12. An improved tamper-proof window unit as set forth in claim 9 wherein the door is of the hollow type with spaced apart side walls, and wherein said end portion of each spring clip arm is disposed in flexed engagement with the inner end surface of a door side wall to restrain the frame against displacement from its central location in the window opening.

13. An improved tamper-proof window unit as set forth in claim 12 wherein said intermediate portion of each spring clip is disposed inwardly of the side wall of the door so as to engage the inner surface of the side wall adjacent its inner edge and to retain the frame temporarily in the door opening during assembly.

14. An improved tamper-proof window unit as set forth in claim 13 wherein said body portion of the arm of each spring clip extends in a direction forwardly and outwardly from said U-shaped portion, the outer surface thereof thus serving as a camming surface with the clip prearranged on the frame and the frame moved perpendicularly inwardly to the window opening in the door, said camming surface engaging the inner edge surface of the side wall of the door and causing the clip arm to be flexed inwardly and then to snap outwardly to its assembled position engaging the inner edge portion of the door side wall and restraining the frame for both location and temporary retention in the window opening in the door.

* * * * *